US009283437B2

(12) United States Patent
Molinari et al.

(10) Patent No.: US 9,283,437 B2
(45) Date of Patent: Mar. 15, 2016

(54) GOLF BALL HAVING PARTIAL CURED UV COATING

(75) Inventors: Arthur P. Molinari, Beaverton, OR (US); Bradley C. Tutmark, Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 1003 days.

(21) Appl. No.: 13/336,780

(22) Filed: Dec. 23, 2011

(65) Prior Publication Data

US 2013/0165245 A1 Jun. 27, 2013

(51) Int. Cl.

| | |
|---|---|
| ***A63B 37/06*** | (2006.01) |
| ***A63B 37/00*** | (2006.01) |
| ***A63B 43/00*** | (2006.01) |
| ***A63B 45/00*** | (2006.01) |
| ***A63B 45/02*** | (2006.01) |
| ***G09F 23/00*** | (2006.01) |
| *A63B 71/06* | (2006.01) |

(52) U.S. Cl.

CPC ..... *A63B 37/0022* (2013.01); *A63B 37/0003* (2013.01); *A63B 37/0074* (2013.01); *A63B 43/008* (2013.01); *A63B 45/00* (2013.01); *A63B 45/02* (2013.01); *G09F 23/0066* (2013.01); *A63B 37/0004* (2013.01); *A63B 2071/0694* (2013.01)

(58) Field of Classification Search

CPC ..... A63B 37/0022
USPC ..... 473/378
See application file for complete search history.

(56) References Cited

U.S. PATENT DOCUMENTS

| | | | | |
|---|---|---|---|---|
| 4,646,446 | A | 3/1987 | Bubley | |
| 5,472,991 | A | 12/1995 | Schmitt et al. | |
| 5,580,323 | A | 12/1996 | Sullivan | |
| 5,655,312 | A | 8/1997 | Sevcik | |
| 5,756,165 | A | 5/1998 | Ali et al. | |
| 5,977,200 | A * | 11/1999 | Lake | 522/75 |
| 6,018,012 | A | 1/2000 | Crast et al. | |
| 6,146,288 | A * | 11/2000 | Crast et al. | 473/377 |
| 6,787,197 | B1 * | 9/2004 | Jaworek et al. | 427/508 |
| 7,198,576 | B2 | 4/2007 | Sullivan et al. | |
| 7,322,122 | B2 | 1/2008 | Overton et al. | |
| 2003/0027667 | A1 * | 2/2003 | Sullivan | A63B 37/0003 473/378 |
| 2003/0073515 | A1 | 4/2003 | Yokota | |
| 2004/0259665 | A1 | 12/2004 | Sullivan et al. | |
| 2008/0081710 | A1 | 4/2008 | Chen et al. | |
| 2009/0120201 | A1 | 5/2009 | Mendoza | |
| 2009/0272058 | A1 | 11/2009 | Duselis et al. | |
| 2011/0064883 | A1 | 3/2011 | Goodwin | |
| 2011/0177884 | A1 | 7/2011 | Ichikawa et al. | |

* cited by examiner

*Primary Examiner* — Raeann Gorden
(74) *Attorney, Agent, or Firm* — Honigman Miller Schwartz & Cohn LLP

(57) ABSTRACT

A golf ball may include a UV curable coating layer that is only partially cured upon finishing. The golf ball may be used in its partially cured state in a game of golf, where the partially cured state may be advantageous for play under wet conditions. The coating layer may then further cure upon exposure to UV light, such as ambient environmental light from the sun during a game of golf in sunny conditions. As a result of this further curing, the coating may transition to a cured state that is associated with play characteristics that are advantageous for play under sunny dry conditions.

2 Claims, 10 Drawing Sheets

GOLF BALL HAVING PARTIAL CURED UV COATING

BACKGROUND

The present disclosure relates generally to the field of golf balls. Specifically, the present disclosure relates to a golf ball having a coating layer that includes a partially cured UV curable material.

The game of golf is an increasingly popular sport at both the amateur and professional levels. A wide range of technologies related to the manufacture and design of golf balls are known in the art. Such technologies have resulted in golf balls with a variety of play characteristics. A golfer may use different golf balls having different play characteristics depending on, for example, the golfer's preferences or the play conditions. For example, different dimple characteristics may affect the aerodynamic properties of the golf ball during flight, or a difference in the hardness of the cover layer may affect the rate of backspin.

A wide variety of dimple characteristics are known to affect the golf ball's aerodynamic properties, such as the dimple pattern, dimple shape and dimple depth. Ideally, the dimples should be designed to achieve the greatest possible total distance by achieving reduced drag and increased lift. As is generally known, drag is the air resistance that opposes the golf ball's flight direction. When drag is reduced, the golf ball achieves increased flight distance. As is also generally known, lift is an upward force on the golf ball that is created by a difference in pressure between the top of the ball and the bottom of the ball. Lift causes the golf ball to achieve increase flight distance, as the upward lift force keeps the golf ball in the air for a longer period of time.

Dimple depth, in particular, can significantly affect the aerodynamics of the golf ball's flight. As is generally known, shallower dimples tends to result in the golf ball rising higher during flight. Conversely, deeper golf ball dimples cause the golf ball to have a lower flight path. It is believed that these tendencies are caused by decreased lift due to greater turbulence of the air inside deeper dimples, although many different aerodynamic phenomenon likely come into play.

Similarly, the hardness of the golf ball's outer layer(s) can also significantly affect a golf ball's play characteristics. Generally, a golf ball with a harder cover layer will achieve reduced spin, but will achieve greater distances. A golf ball with a harder cover layer will therefore be better for drives, but more difficult to control on shorter shots. On the other hand, a golf ball with a softer cover will generally experience more spin and therefore be easier to control and stop on the green, but will lack distance off the tee.

Consequently, a golfer may desire to use a golf ball having different dimple depths or different cover layer hardness, depending on a variety of factors. For example, weather conditions or the golfer's athletic abilities may affect whether shallow dimples or deeper dimples, or a harder cover layer or a softer cover layer, will better achieve the desired play characteristics.

In particular, wet play conditions due to rainy weather can significantly affect a golf ball's play characteristics. During wet weather, the presence of water on the surface of the golf ball decreases friction between the golf club face and the golf ball. This decreased friction causes the golf ball to experience a lower trajectory flight path, and also decreases spin on the ball. This decreased spin reduces the amount of control the golfer has over the golf ball's flight path and landing conditions.

Furthermore, in wet weather the ground will generally be soft. Soft ground conditions will tend to prevent the golfer from having better control over the golf ball's behavior after its initial landing. A golfer playing golf in wet conditions may therefore desire to achieve increased spin, and a higher flight path trajectory, in order to achieve better control over the golf ball. Conversely, in dry weather the hard ground will allow the golf ball to achieve further distance through roll, and a golfer may thereby prefer a lower flight path trajectory in order to maximize total shot distance (including roll). Wet weather conditions therefore present specific challenges to achieving optimal golf ball play characteristics.

Also, amateur golfers generally prefer to minimize the costs of purchasing new golf balls. However, a golfer may be required to purchase several sets of golf balls in order to achieve different play characteristics. Namely, a golfer may be required to purchase one set of golf balls for use in normal weather conditions and another separate set of golf balls for use in wet weather conditions. The need to purchase, store and carry several sets of golf balls in order to achieve a variety of play characteristics presents an inconvenience to the golfer, as well as increased costs.

Therefore, there is a need in the art for a golf ball and method that addresses the shortcomings of the prior art discussed above.

SUMMARY

In one aspect, this disclosure provides a golf ball comprising: a core; a cover layer substantially surrounding the core, the cover layer including at least one dimple, and at least one land area adjacent to the dimple; a coating layer overlapping at least a portion of the cover layer; at least a portion of the coating layer being comprised of a UV curable material; wherein the UV curable material has a first configuration associated with a first degree of curing, and a second configuration associated with a second degree of curing, the second degree of curing being different from the first degree of curing; and the UV curable material is configured to transition from the first configuration to the second configuration upon being exposed to UV light by a user; and wherein the golf ball is a finished golf ball that is configured to be usable in a game of golf in either of the first configuration or the second configuration.

In a second aspect, this disclosure provides a golf ball comprising: a core; a cover layer substantially surrounding the core, the cover layer including a plurality of dimples thereon; a coating layer substantially surrounding the cover layer; at least a portion of the coating layer being comprised of a UV curable material; wherein the UV curable material is partially cured; and the UV curable material is configured to transition from a partially cured state to a substantially fully cured state upon being exposed to ambient environmental UV light during use of the golf ball in a game of golf.

In a third aspect, this disclosure provides a method of manufacturing a golf ball, the method comprising the steps of: receiving a golf ball core substantially surrounded by a cover layer, the cover layer having at least one dimple and at least one land area adjacent to the dimple; coating at least a portion of the cover layer with a coating layer, the coating layer being comprised of a UV curable material; partially curing the UV curable material, such that the coating layer is configured to physically change from a partially cured state to a substantially fully cured state upon being exposed to ambient environmental UV light by a user.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

This disclosure can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Generally, this disclosure relates to golf balls having a ultra-violet ("UV") curable coating layer that is only partially cured, such that the coating layer may undergo further curing in order to customize the golf ball's play characteristics in response to play conditions.

Figure 1:
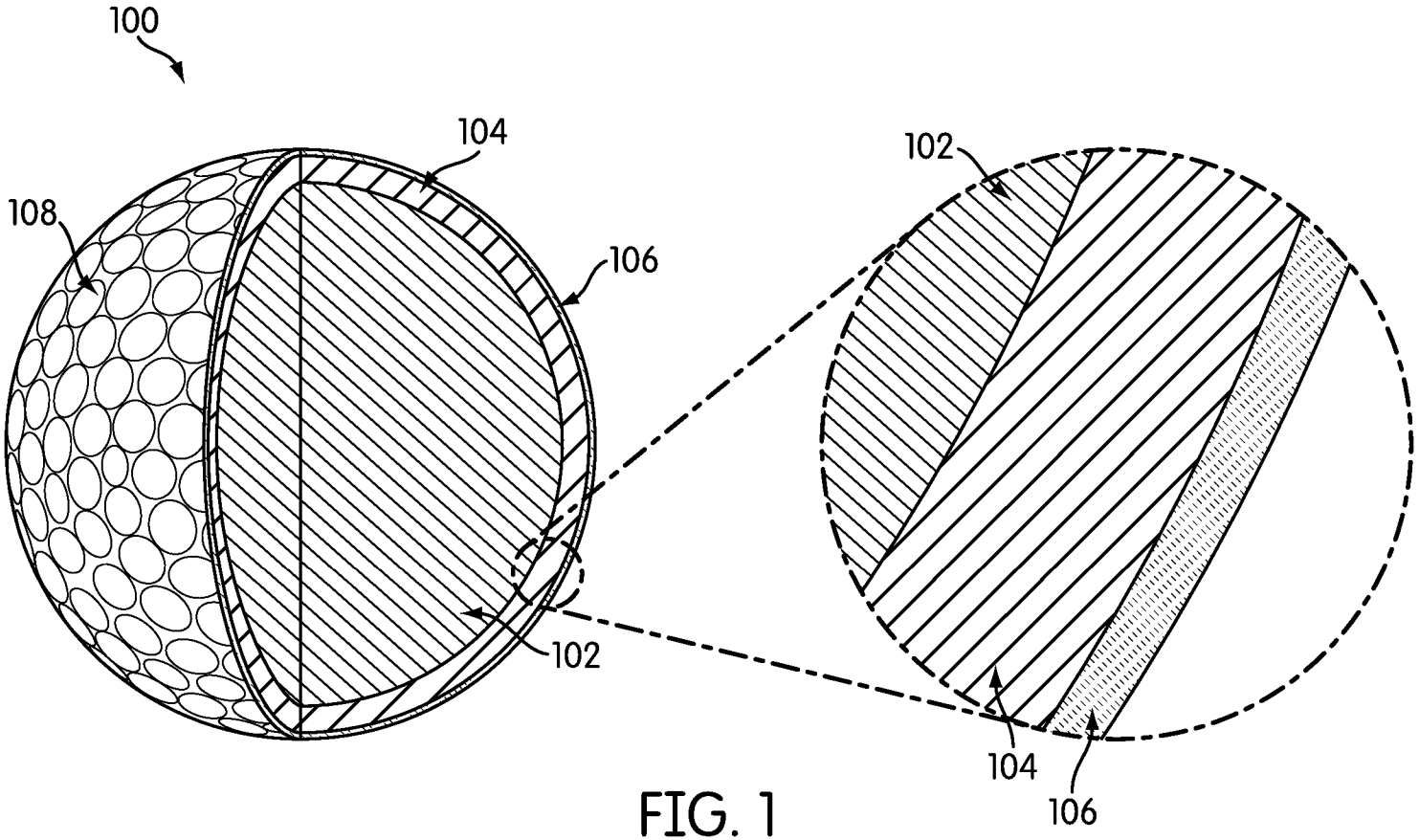
FIG. 1 shows an embodiment of a golf ball including three structural layers.

FIG. 1 shows an embodiment of a golf ball 100 in accordance with this disclosure. Golf ball 100 includes three structural layers. First, core 102 is the innermost layer. Next, cover layer 104 may be disposed around core 102 so as to substantially surround core 102. Finally, coating lay 106 may be disposed on top of cover layer 104. Although FIG. 1 shows coating layer 106 as overlapping substantially the entirety of cover layer 104, in other embodiments coating layer 106 may overlap some portion of cover layer 104 that is less than the entirety of cover layer 104.

Except as otherwise discussed herein below, golf ball 100 may generally be any type of golf ball known in the art. Namely, unless the present disclosure indicates to the contrary, golf ball 100 may generally be of any construction conventionally used for golf balls, and may be made of any of the various materials known to be used in golf ball construction. For example, golf ball 100 may include additional layers that are not shown in FIG. 1. Such additional layers may include, for example, one or more additional inner layers between core 102 and cover layer 104, or one or more additional finishing layers. Additional inner layers may include layers commonly associated with "three piece" golf balls, "multi-piece" golf balls, or other additional inner layers. Finishing layers may include, for example, clear coating layers, cosmetic marking layers, or other finishing layers. Such finishing layers may be located between cover layer 104 and coating layer 106, or on top of coating layer 106, for example.

Golf ball 100 also includes a plurality of dimples 108. The plurality of dimples 108 may generally be arranged on cover layer 104 in any pattern, as may be known in the art of golf balls. Various known dimple packing patterns are known in the art. Dimples 108 may generally be of any shape, such as circular, triangular, or multi-sided. Dimples 108 may be of uniform shape and size, or the dimple pattern may be made up of two or more different types of dimples having (for example) different sizes or different shapes.

Figure 2:
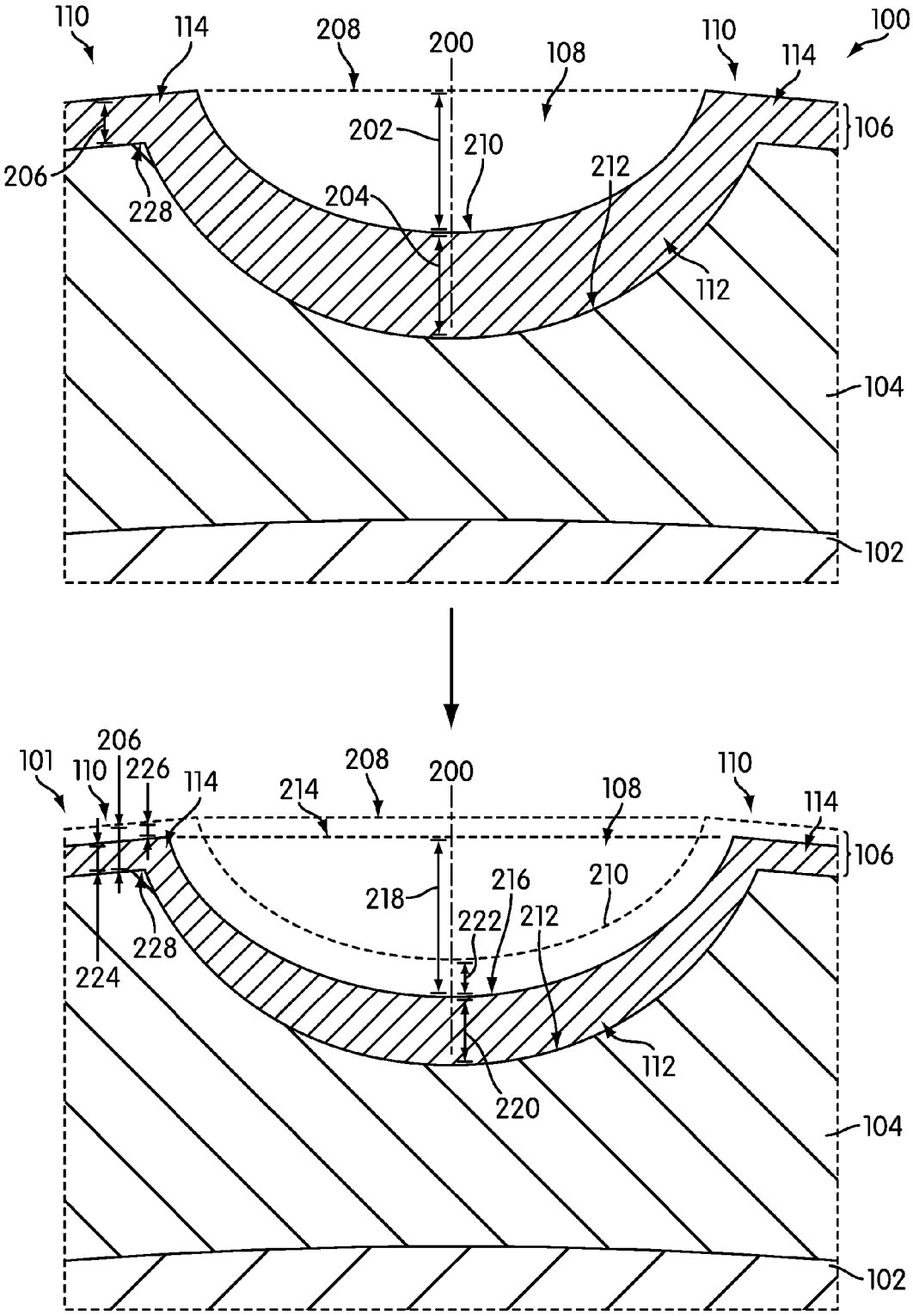
FIG. 2 shows a cross-sectional view of a first embodiment of a portion of a golf ball, in a first configuration and a second configuration.

One particular dimple 108 is shown in greater detail in FIG. 2. FIG. 2 shows a cross-sectional view of a single dimple 108, in a first configuration (top) and a second configuration (bottom). Specifically, cross-sections of core 102, cover layer 104 and coating layer 106 are shown in FIG. 2. Dimple 108 is surrounded by land area 110. At least one land area 110 is a part of cover layer 104 that separates at least two dimples 108, and that is not indented or otherwise part of a dimple. Generally, land area 110 is the "ridge" or "fret" between adjoining dimples 108. Golf ball 100 may include one continuous land area 1010 across the entire cover layer, as is shown in FIG. 1, or a plurality of separate land areas between the plurality of dimples 108. Dimple 108 is defined as the area under line 208, where line 208 is defined by the upper most surface of land area 104.

Cover layer 104 includes surface 212 where cover layer 104 and coating layer 106 meet in dimple 108, and surface 228 where cover layer 104 and coating layer 106 meet on land area 110. Coating layer 106 includes land portion 114 overlapping cover layer 104 at land areas 110. Coating layer 106 also includes dimple portion 112 overlapping cover layer 104 at dimple 108.

FIG. 2 shows how coating layer 106 may transition from a first configuration to a second configuration. First configuration is shown on the top of FIG. 2, and is denoted by golf ball 100. Second configuration is shown at the bottom of FIG. 2, and is denoted by golf ball 101. Coating layer 106 transitions from first configuration 100 to second configuration 101 in response to certain stimuli, based on certain chemical processes, as discussed below. The first configuration and the second configuration are different, and may be associated with different structural arrangements of coating layer 106 as well as other properties of coating layer 106.

In particular, at least a portion of coating layer 106 may comprise a UV curable material. As is generally known, a UV curable material may be any material that polymerizes ("cures") in response to electromagnetic radiation in the UV spectrum. The UV spectrum generally has a wavelength in the range about 10 nm to about 400 nm, and energies from about 3 eV to about 124 eV.

Polymer coatings that cure in response to ultra-violet light are well known in the chemistry arts. For example, a variety of unsaturated monomers may be cured in response to UV light through free radical polymerization, such as acrylates. Other UV curable polymers generally include cationic vinyl systems, and cationic epoxy systems. A wide range of UV curable materials that may be appropriate for use in the present disclosure are discussed in U.S. Pat. No. 7,198,576 to Sullivan et al, the disclosure of which is hereby incorporated by reference in its entirety.

Further UV curable materials, as well as methods for curing UV curable materials, are discussed in U.S. Pat. No. 7,322,122 to Overton, the disclosure of which is hereby incorporated by reference in its entirety. U.S. Pat. No. 5,756,165 to Ali et al. also discusses methods for UV curing and the associated chemistry, the disclosure of which is hereby incorporated by reference in its entirety. These references are merely exemplary, and persons having ordinary skill in the art may substitute other known UV curable compositions, as may be suitable for the construction and purposes of the golf ball coating layers disclosed herein.

Generally, the curing process of a UV curable material causes a UV curable monomer or oligomer to polymerize into a polymer. The term "UV curable material" as used herein encompasses both the starting reactant monomers/oligomers as well as the product polymers, and further includes any intermediates therebetween, and any other components of the polymer system such as a photoinitiator or other additives.

As a result of the curing process, the UV curable material may undergo a variety of physical changes. Namely, when uncured the UV curable material is usually a liquid, and then becomes a soft tacky solid upon partial curing, and then is a hard smooth solid upon full curing. The general process of partial curing followed by full curing, as well as the UV light intensities and timing required, is discussed in U.S. Pat. No. 7,322,122 to Overton, as mentioned above. The changes in physical properties between partial curing and fully curing may be used in this disclosure to achieve advantageous properties of a golf ball.

Specifically, the first configuration 100 of a golf ball may be associated with a first degree of curing. The second configuration 101 of a golf ball may then be associated with a second degree of curing, where the second degree of curing is different from the first degree of curing. In embodiments, the first degree of curing is at least partially cured. The term "partially cured" as used herein is used to denote at least about 5% of the total polymerization required to achieve a substantially full cure. The term "substantially full cure" as used herein is used denote a degree of curing such that physical properties of the UV curable material do not noticeably change upon further exposure to additional UV radiation. In various embodiments, partially cured may refer to at least about 10% of the total polymerization of a full cure, or at least about 20%, or at least about 50%, or at least about 75%, or at least about 95%. In some embodiments, the second degree of curing may be greater than the first degree of curing. In further embodiments, the second degree of curing may be substantially fully cured.

The UV curable material may also be mixed with one or more additional materials. A second material with which the UV curable material may be mixed may be a non-UV curable material. For example, the UV curable material may be mixed with a material that cures through a method other than UV curing. A wide range of coating chemistries are known that may be so mixed. For example, materials that cure in response to heating, exposure to water, or dehydration may be mixed with the UV curable material. In particular, a polyurethane coating may be so mixed. Polyurethane coatings are widely known in the golf ball arts. For example, U.S. Pat. No. 6,018,012 to Crast et al., discusses a wide range of polyurethanes and their associated chemistry that may be used herein, the disclosure of which is hereby incorporated by reference in its entirety.

Mixing a second material may allow for the coating layer 106 to be fully formed and performing coating layer functions such as sealing cover layer 104 and core 102 from moisture, because the second material may be fully cured even while the UV curable material may be only partially cured. The UV curable material and the second material may be mixed in any ratio as may be necessary. For example, these materials may be mixed in a ratio of about 1 part UV curable material to about 10 parts second material.

Some of the various physical changes that the UV curable material may undergo as a result of the transition from the first configuration to the second configuration are discussed as follows.

In first configuration 100, as shown in FIG. 2, coating layer 106 land portion 114 has a thickness 206. Thickness 206 is defined as the distance from cover layer 104 land portion 228 to the top surface of coating layer 106 land portion 114, as donated by line 208. Coating layer dimple portion 112 has a thickness 204. Thickness 204 is defined as the distance from cover layer 104 dimple portion 212 to cover layer 106 dimple top surface 210. In the embodiment shown in FIG. 2, thickness 204 is greater than thickness 206. However, in other embodiments, thickness 206 and thickness 204 may have other relative values.

Dimple 108 has a first dimple depth 202 in first configuration 100. First dimple depth 202 is defined as the distance between first dimple bottom surface 210 and line 208. First dimple depth 202 as shown is measured at the center axis 200 of dimple 108. However, the phrase "dimple depth" as used in the present disclosure need not necessary be measured at center axis 200 of dimple 108, but may generally be understood as the distance between the top 208 of dimple 108 and the bottom surface 210 of dimple 108 at any particular point, or (for example) as an average of this distance across dimple 108.

As shown in the lower portion of FIG. 2, coating layer 110 is configured to be capable of undergoing a physical change into the second configuration 101. In the embodiment shown, the physical change includes an contraction, such that coating layer 106 contracts as it changes from first configuration 100 to second configuration 101. The contraction causes the shape of the coating layer to change in various ways. For example, land portions 114 of coating layer 106 contract from first configuration thickness 206 to second configuration thickness 224, the difference between these thicknesses being distance 226. Land portions 114 of coating layer 106 therefore have a second configuration topmost surface 214.

Similarly, dimple portion 112 of coating layer 106 contracts from first configuration thickness 204 to second configuration thickness 220, the difference between these thicknesses being distance 222. Dimple portion 114 of coating layer 110 therefore has a new, second configuration surface 216.

As a result of these thicknesses, the contraction that occurs when the golf ball transitions from first configuration 100 to second configuration 101 may cause the dimple depth to change. In other words, the first configuration 100 may be associated with first dimple depth 202 while the second configuration 101 may be associated with a second dimple depth 218. Second dimple depth 218 is measured between second configuration topmost land surface 214 and second configuration dimple bottom surface 216. Generally, second dimple depth 218 may be any dimple depth that is different from first dimple depth 202. However, in the particular embodiment shown, second dimple depth 218 is greater than first dimple depth 202. In certain embodiments, second dimple depth 218 may be greater than first dimple depth 202 by a specific percentage. For example, second dimple depth 218 may be 110% or more greater than dimple depth 202, or second dimple depth 218 may be 120% or more greater than first dimple depth 202, or second dimple depth 218 may be 130% or more greater than first dimple depth 202.

In the particular embodiment shown in FIG. 2, the change in dimple depth between the first configuration and the second configuration is caused by the difference in thickness of the land area portions 114 and the dimple portion 112 of coating layer 106. In other words, the greater thickness 204 of the dimple portion 112 of coating layer 106 as compared to thickness 206 in the land portions 114 causes the distance 222 contracted in dimple 108 to be larger than the distance 226 contracted on land 110. This occurs even though the cover layer 106 may contract at the same rate (distance 226 over distance 206, and distance 222 over distance 204) throughout.

The change in thickness (distance 226 or distance 222) may generally be any reasonable change in the thickness of coating layer 106. In particular embodiments, the change in thickness may be less than or equal to about 10% of the respective first configuration thickness. In other words, coating layer 106 may contract by less than or equal to about 10% during transition from first configuration 100 to second configuration 101. In other embodiments, coating layer 106 may contract by less than or equal to about 5%. In embodiments, the change in thickness may be at least about 1% of the thickness in first configuration 100, or at least about 3%, or at least about 5%.

With reference back to FIG. 1, the changes in dimple 108 shown in FIG. 2 may occur with respect to one or more of the plurality of dimples across the entirety of golf ball 100. In certain embodiments, fewer than all of the plurality of dimples may be configured to undergo a change from first configuration 100 to second configuration 101. For example, a certain subset of the plurality of dimples arranged in a desired pattern may be configured to so change. Such a pattern may be, for example, spherically symmetric or non-spherically symmetric. Certain symmetric patterns of the dimples configured to change may meet United States Golf Association (U.S.G.A.) standards for regulation play golf balls. Specifically, a golf ball may include a pattern of dimples configured to change, such that the pattern of changeable dimples causes the golf ball to meet U.S.G.A. rules Section 7.3 standards for symmetry.

In other embodiments, as shown in FIG. 1, all of the plurality of dimples may be configured to undergo a change from first configuration 100 to second configuration 101. In other words, all of the dimples 108 on golf ball 100 may have the same first dimple depth 202 prior to any change in coating layer 106. Consequently, after a change in coating layer 106, all of the dimples 108 may have the same second dimple depth 218. The change in the dimples therefore may take place uniformly across all of the plurality of dimples.

In addition to the changes discussed above, coating layer 106 may undergo other changes when transitioning from first configuration 100 to second configuration 101.

For example, coating layer 106 may change hardness. First configuration may be associated with coating layer 106 having a first hardness, while second configuration 101 may be associated with coating layer 106 having a second hardness. The second hardness may be different from the first hardness. The first hardness and the second hardness may generally be of any hardness value commonly associated with golf ball outer layers, for example about 40 to about 80 on the Shore D scale. In particular embodiments, the second hardness is harder (i.e. great value on a hardness scale) then the first hardness. In some embodiments, the second hardness is at least two units on the Shore D scale softer than the first hardness. In other embodiments, the second hardness is at least three units on the Shore D scale softer than the first hardness, or at least five units.

Another example of a change when transitioning from first configuration 100 to second configuration 101 may be a change in coefficient of friction of coating layer 106. This coefficient of friction may be as measured against a golf club face, or may be any constant material against which both the first configuration 100 and second configuration 101 are compared. As mentioned above, a partially cured UV curable material may be at least partially "tacky" or "sticky." This "tackiness" will cause the partially cured coating layer 106 to have an increased coefficient of friction relative to a substantially fully cured coating layer 106. Therefore, first configuration 100 may be associated with a first coefficient of friction, while second configuration 101 may be associated with a second coefficient of friction, where the first coefficient of friction and the second coefficient of friction are different. In embodiments, the second coefficient of friction may be lower than the first coefficient of friction.

In both of the first configuration and the second configuration, the golf ball 100 or golf ball 101 may be a finished golf ball that is configured to be usable in a game of golf by a golfer.

Figure 3:
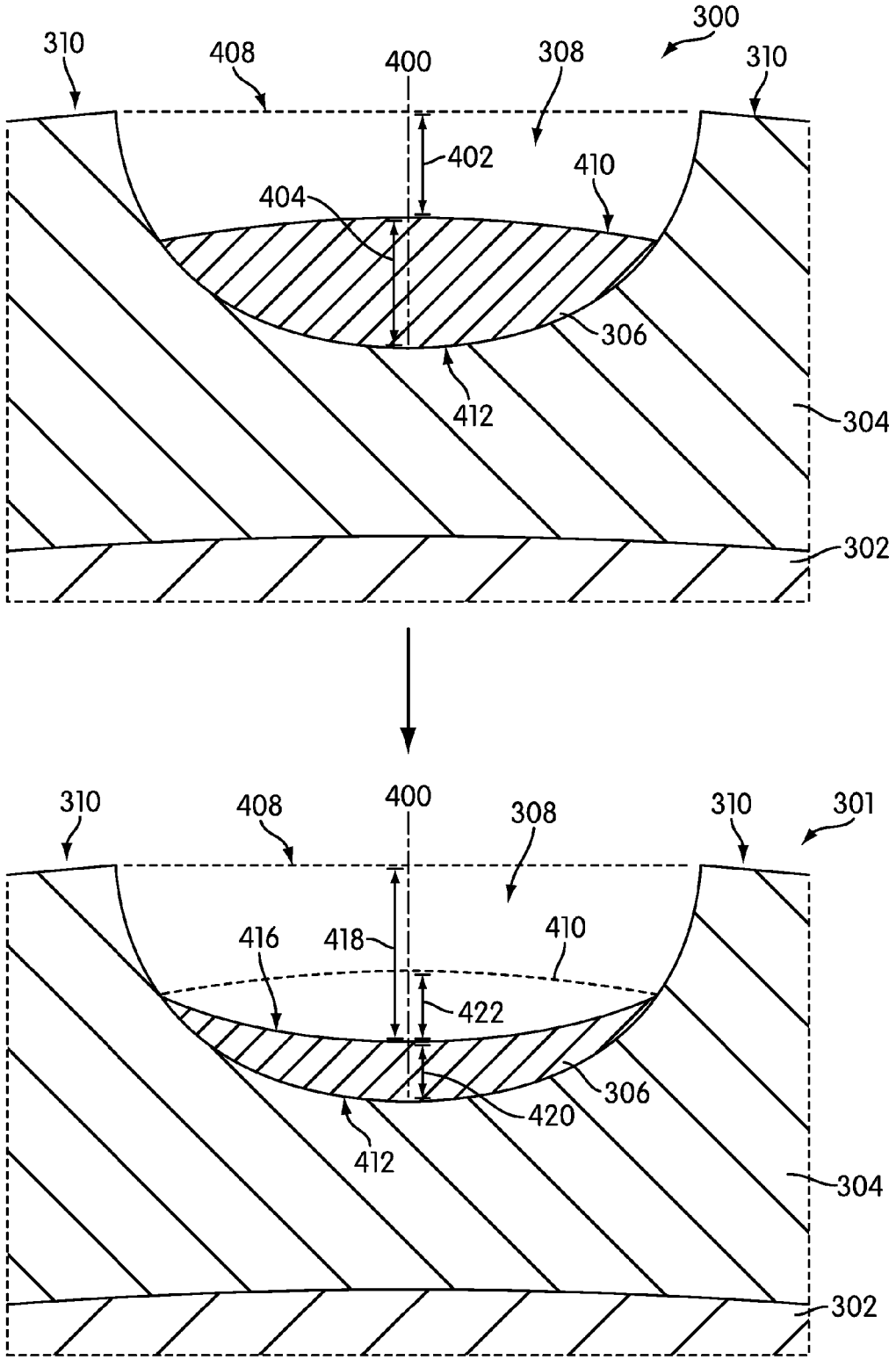
FIG. 3 shows a cross-sectional view of a second embodiment of a portion of a golf ball, in a first configuration and a second configuration.

FIG. 3 shows a second embodiment of a golf ball in a first configuration 300 and in a second configuration 301, in accordance with the present disclosure. In this embodiment, a coating layer 306 overlaps a dimple portion 308 of cover layer 304, specifically at surface 412. Coating layer 306 does not overlap land portions 310 of cover layer 304. Coating layer 306 may overlap each dimple portion 308 in a plurality of dimples on a golf ball, such that coating layer 306 may collectively be comprised of each separate coating portion across the entirety of a golf ball 300. Alternatively, coating layer 306 may overlap fewer than all of a plurality of dimples on golf ball 500.

As in the embodiment of FIG. 2 discussed above, coating layer 306 may exist in a first configuration 100 as shown in the upper half of FIG. 3. The first configuration may be associated with first dimple depth 402, as measured between first configuration dimple bottom surface 410 and line 408 defined by land portion 310 at dimple center axis 400. First configuration 100 may also be associated with coating layer 306 having a first configuration thickness 404, as measured between cover layer 304 surface 412 and first configuration dimple bottom surface 410.

Coating layer 306 may then undergo a physical change from first configuration 100 to second configuration 101, as shown in the lower half of FIG. 3. Second configuration 101 may be associated with second dimple depth 418, as measured between second configuration dimple bottom surface 416 and line 408 at dimple center axis 400. Second configuration 101 may also be associated with coating layer 306 having a second configuration thickness 420, as measured between cover layer surface 412 and second configuration dimple bottom surface 416. The difference between first dimple depth 402 and second dimple depth 418 is shown as distance 422.

In addition to the change in thicknesses and dimple depths discussed above, the embodiment of FIG. 3 (and any other embodiment discussed in this disclosure) may also experience the other physical changes that may be associated with the transition from a first configuration to a second configuration, such as changes in the hardness and coefficient of friction, as discussed above.

In addition to the change in dimple depth discussed above, the embodiment shown in FIG. 3 may also achieve other advantageous effects. In this embodiment, because coating layer 306 does not overlap land areas 310, a change in the hardness of coating layer 306 may create "zones" of differing hardness. Such hardness zones are discussed in detail in commonly-owned U.S. Pat. No. 8,556,750, currently application Ser. No. 12/690,761, titled "Golf Ball With Cover Having Varying Hardness," filed Jan. 20, 2010, the disclosure of which is hereby incorporated by reference in its entirety.

Figure 4:
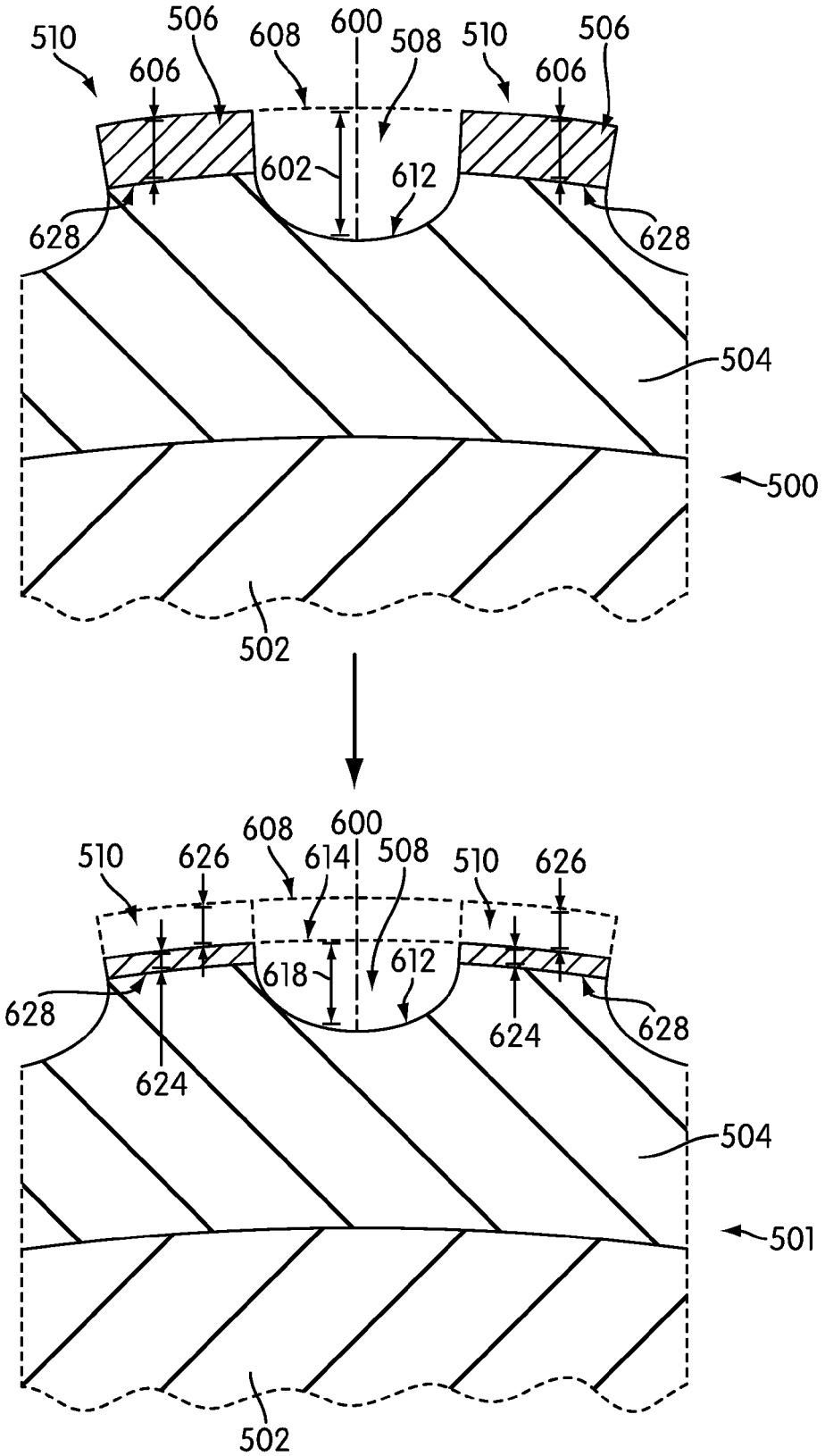
FIG. 4 shows a cross-sectional view of a third embodiment of a portion of a golf ball, in a first configuration and a second configuration.

FIG. 4 shows a third embodiment of a golf ball in a first configuration 500 and in a second configuration 501, in accordance with this disclosure. In this embodiment, a coating layer 506 overlaps a land portion 510 of cover layer 504, specifically at surface 628. Coating layer 506 does not overlap dimple portion 508 of cover layer 504. Coating layer 506 may overlap each land portion 510 throughout the entire surface of cover layer 504 on a golf ball, or some subset thereof.

As in other embodiments discussed above, coating layer 506 may exist in a first configuration 100 as shown in the upper half of FIG. 4. The first configuration 100 may be associated with first dimple depth 602, as measured between first configuration dimple bottom surface 612 and line 608 defined by land portion 510 at dimple center axis 600. First configuration 100 may also be associated with coating layer 506 having a first configuration thickness 606, as measured between cover layer 504 surface 628 and line 608 as shown.

Coating layer 506 may then undergo a physical change from first configuration 500 to second configuration 501, as shown in the lower half of FIG. 4. Second configuration 501 may be associated with second dimple depth 618, as measured between dimple bottom surface 612 and line 614 defined by land area 510 coating layer 506 at dimple center axis 600. Second configuration 501 may also be associated with coating layer 506 having a second configuration thickness 624, as measured between cover layer surface 628 and line 614 as shown. The difference between first configuration thickness 606 and second configuration thickness 624 is shown as distance 626, which in this embodiment is also the difference between first dimple depth 602 and second dimple depth 618. Therefore, in this embodiment coating layer 506 is associated with only land areas 510 and does not overlap dimple 508.

The embodiment of FIG. 4 may also be used to achieve other advantageous effects, such as are described in commonly-owned U.S. Pat. No. 8,556,750, currently application Ser. No. 12/690,761, titled "Golf Ball With Cover Having Varying Hardness," filed Jan. 20, 2010, as mentioned above.

Figure 5:
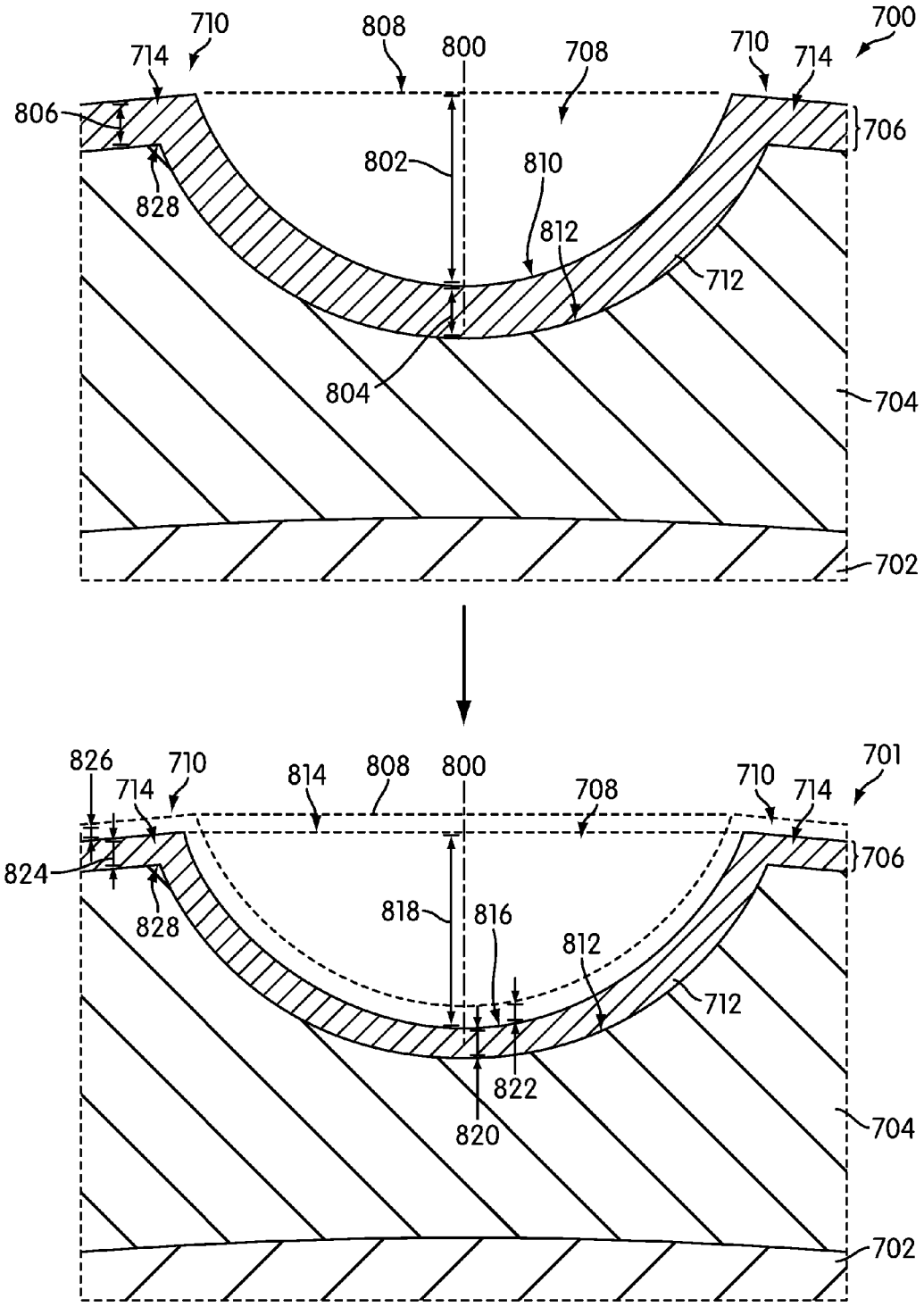
FIG. 5 shows a cross-sectional view of a fourth embodiment of a portion of a golf ball, in a first configuration and a second configuration.

FIG. 5 shows a fourth embodiment of a golf ball in first configuration 700 and second configuration 701, in accordance with the present disclosure. This embodiment includes a coating layer 706 that overlaps a dimple portion 708 and land portions 710 with a uniform thickness. Namely, thickness 806 of coating layer 706 in land portions 710 is the same as thickness 804 of coating layer 706 in dimple portion 708.

In this embodiment, coating layer 706 has a uniform thickness and may be made of a uniform continuous material. As a result, the physical change from the first configuration 700 to the second configuration 701 may not change the dimple depth. The first configuration 700 may be associated with first dimple depth 802, as measured between first configuration dimple bottom surface 810 and line 808 at dimple center axis 800. The second configuration may be associated with second dimple depth 818, as measured between second configuration dimple bottom surface 816 and line 814 defined by top surface of land areas 710. In this embodiment, distance 826 by which land portions 710 of coating layer 706 contract is the same as distance 822 by which dimple portion 708 of coating layer 706 contracts. Therefore, first dimple depth 802 and second dimple depth 818 are substantially the same, as are all of thicknesses 804 and 806 (in the first configuration 700) and thicknesses 820 and 824 (in the second configuration 701).

Although this embodiment is not configured to change dimple depth, coating layer 706 may nonetheless undergo other physical changes such as a change in hardness and a change in coefficient of friction, as discussed above.

Figure 6:
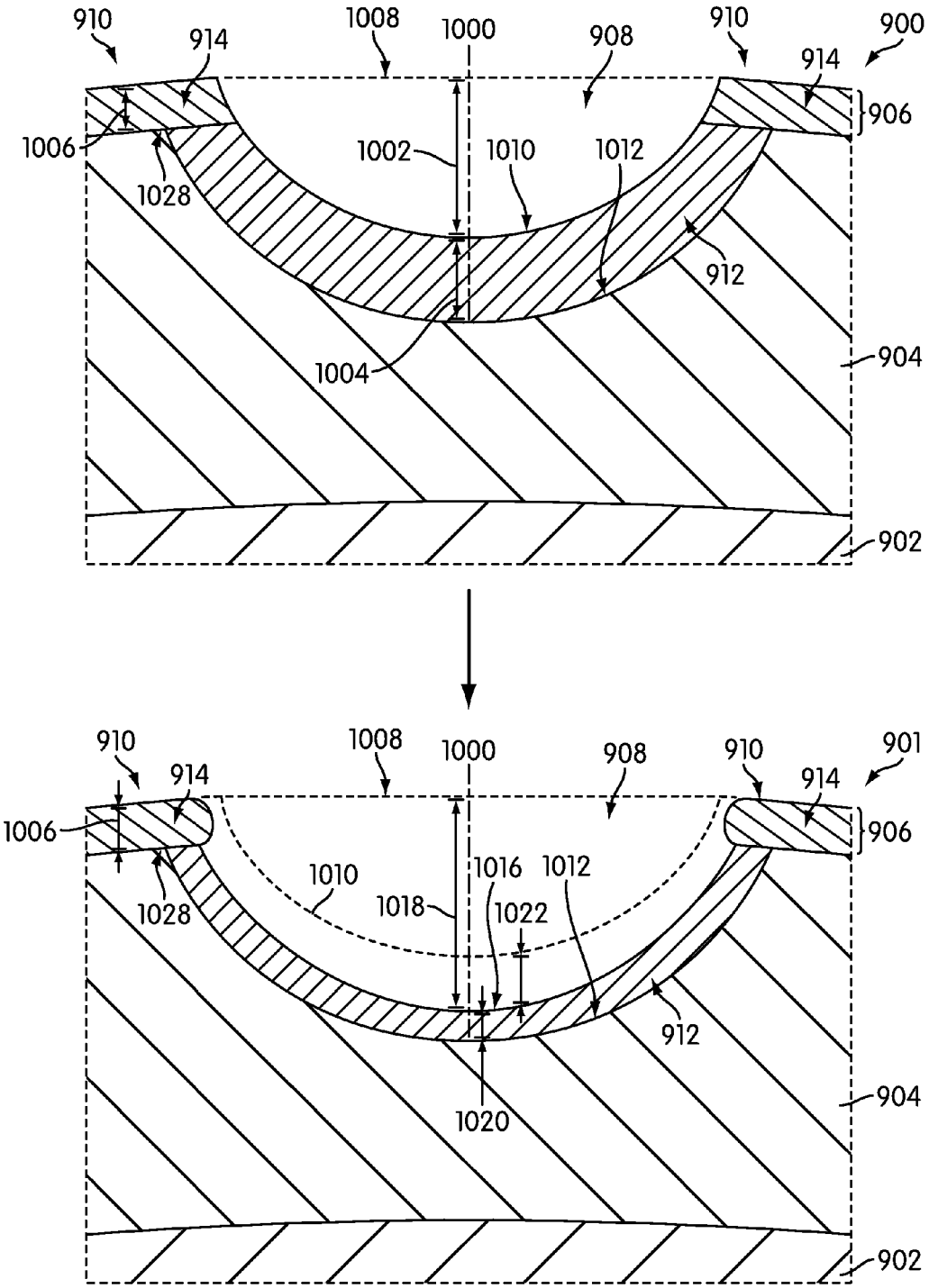
FIG. 6 shows a cross-sectional view of a fifth embodiment of a portion of a golf ball, in a first configuration and a second configuration.

FIG. 6 shows a fifth embodiment of a golf ball in a first embodiment 900 and second embodiment 901, in accordance with the present disclosure. This embodiment includes a coating layer 906 overlapping at least a dimple 908 portion of cover layer 904, and overlapping at least one land area 910 portion of cover layer 904. However, in this embodiment, dimple portion 908 of coating layer 906 comprises the UV curable material, while land portion 914 of coating layer 906 does not comprise the UV curable material. Instead, land portion 914 of coating layer 906 comprises a material that is not UV curable. This material therefore may not change during the transition from the first configuration 900 to the second configuration 901.

As shown in the top portion of FIG. 6, the thickness of coating layer dimple portion 912 may be thickness 1004, as measured between cover layer dimple portion surface 1012 and first configuration dimple surface 1010. Coating layer 906 in land area 914 may have thickness 1006, as measured between cover layer 904 land area surface 1028 and line 1008 as shown. First configuration 900 may therefore be associated with first dimple depth 1002, as measured between first configuration dimple surface 1010 and line 1008 as shown.

As a result of the presence of the non-UV curable material in land areas 910, dimple portion 912 of cover layer 906 undergoes a physical change into a second configuration 901, while land portion 914 does not substantially change aside from minor changes at the interface of dimple portion 912 and the edge of non-UV curable material land portion 914. Namely, dimple portion 912 of cover layer 906 may contract in second configuration 901. Second configuration 901 may be associated with second dimple portion 912 thickness 1020, as measured between dimple cover layer surface 1012 and second configuration dimple surface 1016. Second configuration 901 may therefore be associated with second dimple depth 1018, as measured between second configuration dimple surface 1016 and line 1008. The difference between first dimple depth 1002 and second dimple depth 1018, thickness 1022, may be greater than the difference between a first dimple depth and a second dimple depth in other embodiments, because dimple portion 912 may contract but land portions 914 may remain at the larger constant thickness 1006 in both configurations.

Figure 7:
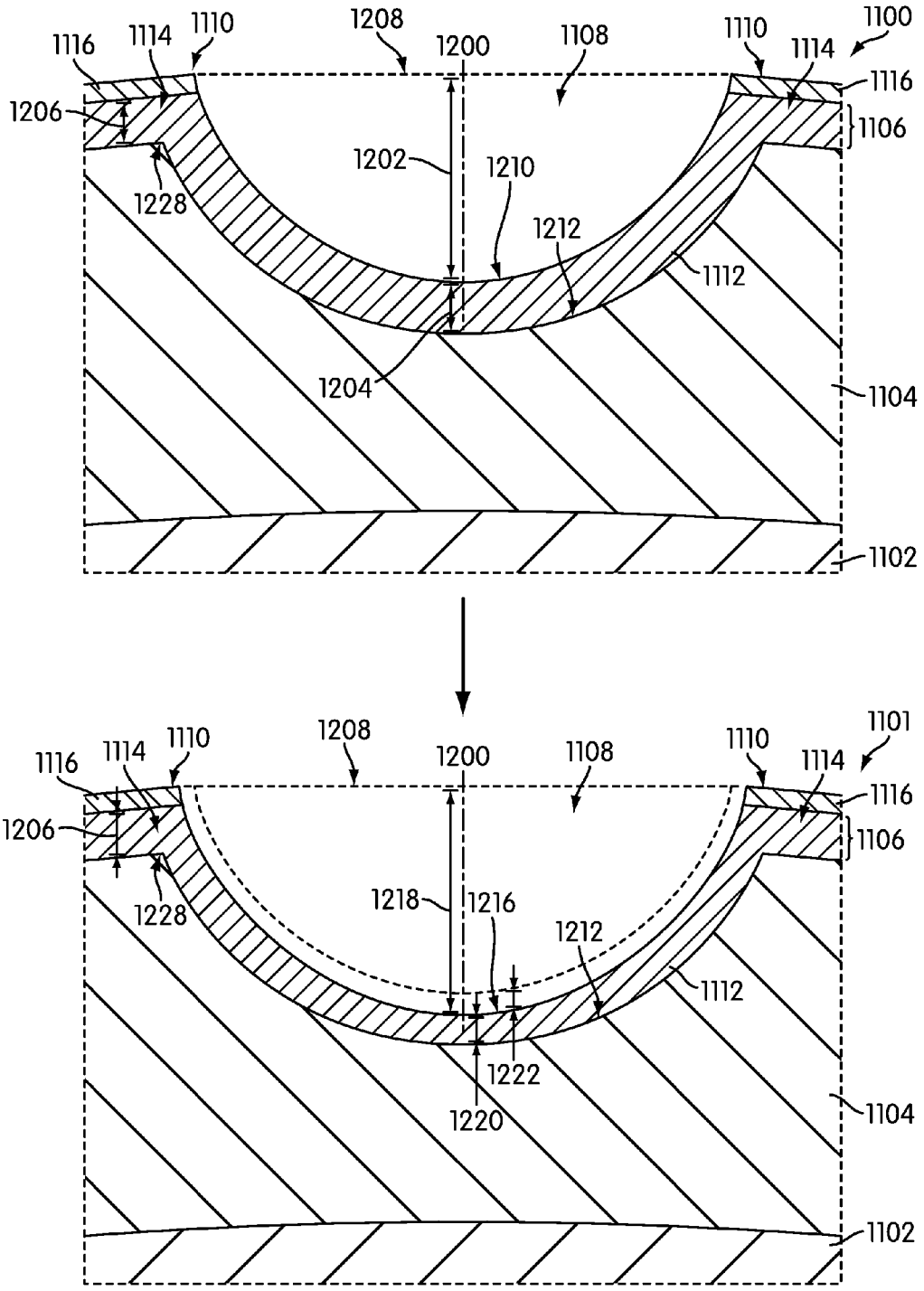
FIG. 7 shows a cross-sectional view of a sixth embodiment of a portion of a golf ball, in a first configuration and a second configuration.

FIG. 7 shows a fifth embodiment of a golf ball 1100 in accordance with this disclosure. Golf ball 1100 may be substantially similar to golf ball 700 as shown in FIG. 5. However, golf ball 1100 may also include blocking layer 1116 on land areas 1110. Blocking layer 1116 may be layered on top of UV-curable coating layer 1106 in land areas 1110. In other embodiments, not shown, blocking layer 1116 may be layered on top of UV-curable coating layer 1106 in any of a variety of patterns. Blocking layer 1116 may serve to selectively prevent land portions 1114 of UV-curable coating layer 1106 from being exposed to UV radiation.

Specifically, golf ball 1100 may exist in a first configuration prior to exposure to UV radiation. In first configuration golf ball 1100 may have dimple depth 1202, as measured from dimple 1108 bottom surface 1210 to top edge 1208 defined by the top of blocking layer 1116. In this first configuration, coating layer 1106 may have thickness 1206 in land portion 1114, as measured between top surface 1228 of cover layer 1104 and the top of coating layer 1106. Similarly, coating layer 1106 may have thickness 1204 in dimple portion 1112.

Upon exposure to UV radiation, golf ball 1100 in first configuration may transition to golf ball 1101 in second configuration as shown in FIG. 7. Here, the presence of blocking layer 1116 on top of land portions 1114 of coating layer 1106 prevents land portion 1114 from changing configuration. As a result, dimple portion 1112 may transition from having thickness 1204 in first configuration 1100 to having thickness 1218 in second configuration. Thickness 1218 may be measured from surface 1216 of coating layer 1106 to top line 1208 defined by the top surface of blocking layer 1114. Therefore, the embodiment shown in FIG. 7 may include a coating layer 1106 having a generally uniform thickness 1204 or 1206 as was shown in FIG. 5, yet also achieve a change in dimple depth.

Blocking layer 1116 may be comprised of any material that substantiate blocks the transmission of UV radiation. For example, blocking layer 1116 may be comprised of a polymer material containing UV absorbents. A variety of UV absorbents, also known as UV stabilizers, are known in the polymer arts. For example, blocking layer 1116 may be comprised of a polymer including UV stabilizers such as benzophenones, oxanilides, or benzotriazoles. In other embodiments, blocking layer 1116 may comprise a UV blocking material such as zinc oxide or titanium itself. For example, blocking layer 1116 may be manufactured by coating UV curable coating layer 1106 with a fine dust of zinc oxide or titanium particles. In some embodiments, the tacky texture of the partially-cure UV curable coating layer 1106 may aid in the adhesion between blocking layer 1116 and coating layer 1106. For example, golf ball 1100 may be rolled in a tray of fine zinc oxide or titanium particles in order to coat land areas 1110 with blocking layer 1116 without coating dimple areas 1108.

The present disclosure also provides a method of manufacturing a golf ball. Generally, the method of manufacturing a golf ball includes: a step of receiving a golf ball core substantially surrounded by a cover layer, the cover layer having at least one dimple and at least one land area adjacent to the dimple; and a step of coating at least a portion of the cover layer with a coating layer, the coating layer being comprised of a UV curable material; and partially curing the UV curable material, such that the coating layer is configured to physically change from a first configuration to a second configuration upon being exposed to UV light by a user. This method may produce a finished golf ball that is configured to be usable in a game of golf in either of the first configuration or the second configuration.

In some embodiments of this method, the first configuration may be a partially cured state, and the second configuration may be a substantially fully cured state.

The method produces a golf ball configured to physically change from a first configuration to a second configuration upon being exposed to UV light by a user. Specifically, the method may produce a golf ball wherein the first configuration is associated with a first dimple depth, the second configuration is associated with a second dimple depth, and the second dimple depth is greater than the first dimple depth. This method may also produce a golf ball wherein the first configuration is associated with the coating layer having a first hardness, the second configuration is associated with the coating layer having a second hardness, the second hardness being harder than the first hardness. Finally, this method may produce a golf ball wherein the first configuration is associated with a first coefficient of friction, the second configuration is associated with a second coefficient of friction, the second coefficient of friction being less than the first coefficient of friction.

Generally, the exposure to UV light by a user may be any type of UV exposure. In some embodiments, the exposure may be to ambient environmental UV light such as from sunlight. Generally, sunlight provides UV light in the form of UV-A and UV-B light. UV-A light generally has a wavelength of from about 300 nm to about 400 nm, while UV-B light generally has a wavelength of from about 200 nm to about 300 nm. When the source of UV radiation is ambient environmental light from sunlight, a golf ball in accordance with this disclosure to be used in its first configuration in low sunlight conditions (such as a cloudy day or at night) and then transition to its second configuration in high sunlight conditions (such as a sunny day).

In other embodiments, the exposure to UV light by a user may occur as a result of being deliberately exposed to artificial UV radiation. For example, a user may place a golf ball in accordance with this disclosure into a UV curing box. UV curing systems such as UV curing boxes are widely known in the printing industry. Some simple examples of UV curing boxes are shown in U.S. Pat. No. 4,646,446 to Bubley, and in U.S. Pat. No. 5,655,312 to Sevcik, the disclosures of which are hereby incorporated by reference in their entirety. A UV box may be owned and operated by a golfer personally, by a golf pro shop associated with a golf course, or by a retail sporting goods store, for example.

Such an artificial UV radiation source may be used to control the timing and conditions of the transition from the first configuration to the second configuration, as desired. For example, to begin with, a golf ball in accordance with this disclosure may be in the first configuration upon completion of manufacturing. The golf ball may then be shipped, stored, and sold while in the first configuration. Next, an end user golfer may purchase the golf ball and use it in one or more games of golf while the golf ball is still in the first configuration. Finally, the end user golfer may use an artificial UV radiation source to cause the golf ball to transition into the second configuration whenever the golfer so desires. Therefore, the golfer may control the timing of the transition from the first configuration to the second configuration.

This method may also include additional optional steps. For example, in embodiments where the coating layer comprises a mixture of the UV curable material and a second curable material that is not UV curable, the method may include a step of mixture the two materials. The method may then include a step of curing the second curable material, such as by applying heat, moisture or drying, for example.

As has been discussed above with respect to the various embodiments of FIGS. 2-7, the method may coat at least a dimple portion of the cover layer, or at least a land portion of the cover layer, or both. In specific embodiments, the method may coat substantially an entirety of the cover layer with the coating layer. In other embodiments, the method may coat any portion of the cover layer that is less than the entirety thereof. The coating may be carried up by any generally known coating method, such as brushing, dipping, molding or plating.

By this process, generally, a consumer may purchase a golf ball in accordance with this disclosure that is configured to transition from the first configuration to the second configuration in order to optimize play characteristics of the golf ball.

Figure 8:
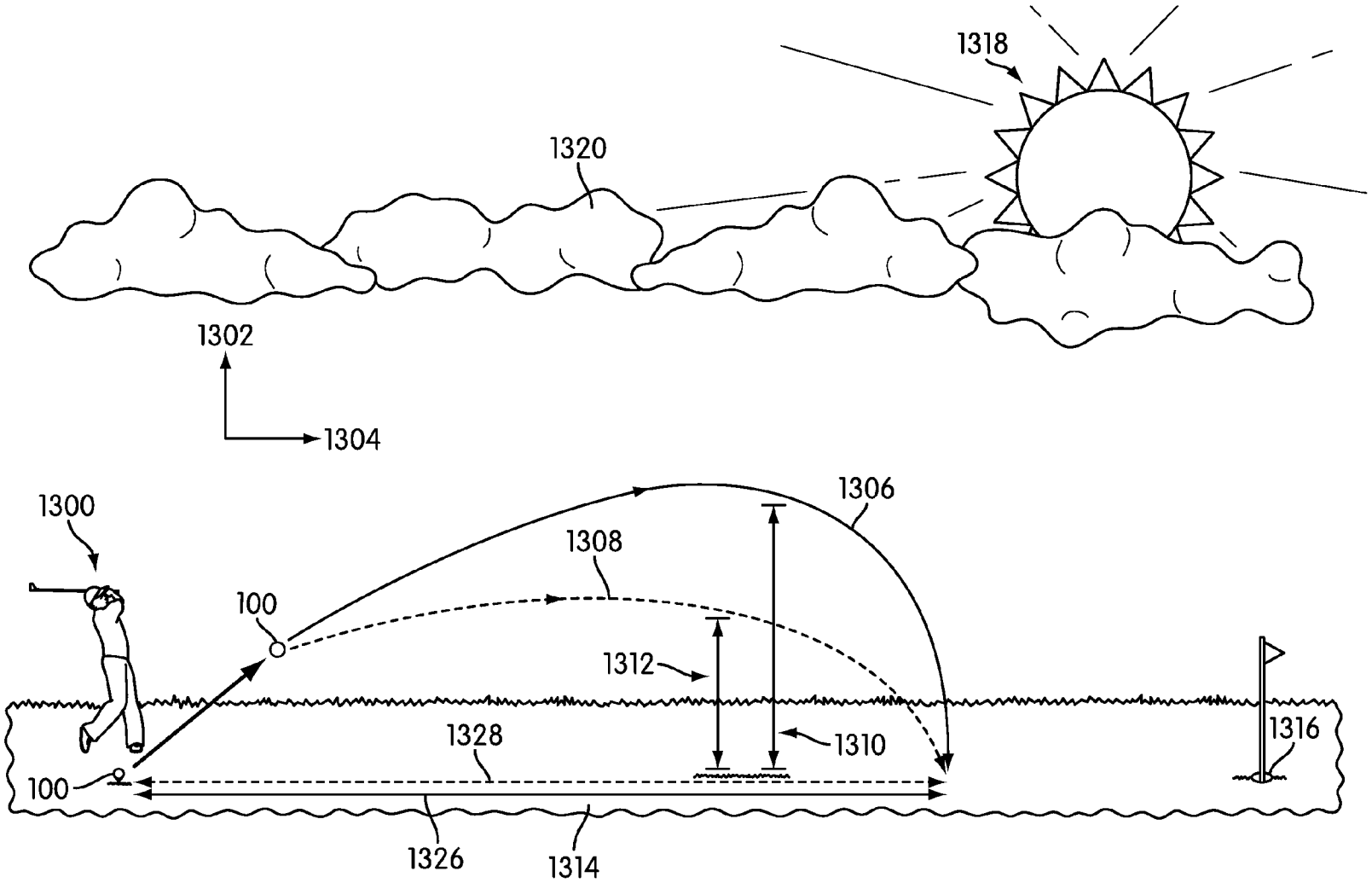
FIG. 8 shows a golf ball in its first configuration in use in a game of golf.
Figure 9:
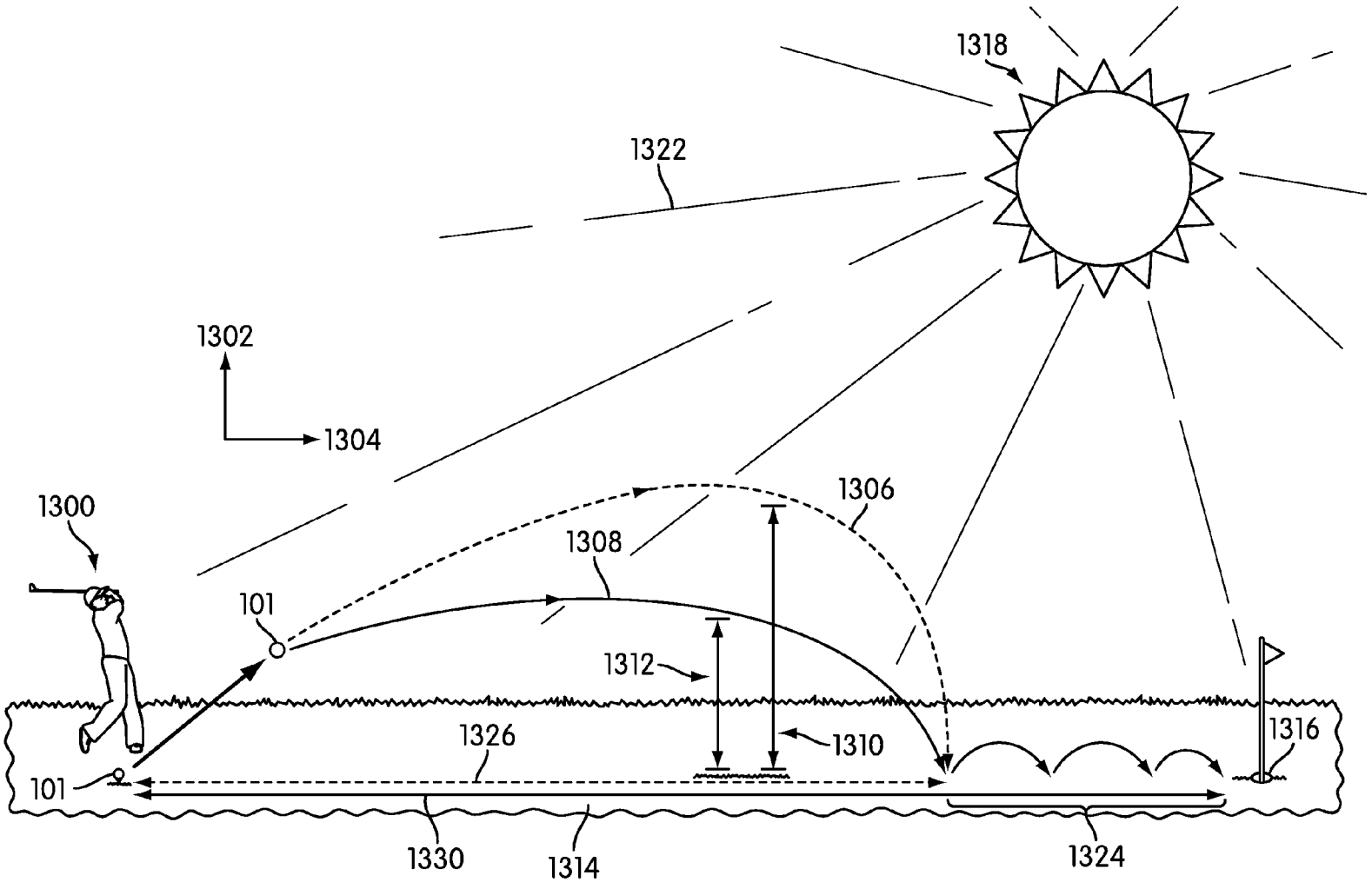
FIG. 9 shows a golf ball in its second configuration in use in a golf of golf.

FIG. 8 and FIG. 9 show how a golf ball in accordance with the present disclosure may be used to compensate for wet weather conditions. Although not wishing to be bound by any particular usage or effect, the change in dimple depth and hardness from the first configuration to the second configuration may generally allow golf ball 100/101 to compensate for the effects of wet weather conditions that would otherwise disadvantage conventional golf balls. Specifically, during wet weather, the ground will be soft and golfers will therefore prefer a higher flight path in order to achieve greater control. In contrast, in dry conditions when the ground is hard, a lower flight path may achieve the greatest total shot distance including roll.

FIG. 8 shows golfer 1300 golfing in wet-weather conditions. Specifically, overcast clouds 1320 obscures the sun 1318 and therefore reduces the amount of ambient environmental UV light reaching the golf ball 100. Golf ball 100 is present in the first configuration, as various discussed above, and remains in the first configuration because golf ball 100 is not substantially exposed to ambient environmental UV sunlight. First configuration may have shallower dimples and a softer hardness than a second configuration. As is generally known in golf, shallower dimples cause a golf ball to achieve a higher flight path 1306 as compared to the flight path 1308 of a similar golf ball having deeper dimples. Flight path 1306 may have vertical height of 1310, while comparative flight path 1308 may have vertical height 1312 that may be less than vertical height 1310. Flight path 1306 may also have horizontal distance 1326 along the fairway 1314. Horizontal distance 1326 may be roughly the same as horizontal distance 1328 of comparative flight path 1308, but may offer increased control due to the angle at which the ball approaches the ground.

On the other hand, FIG. 9 shows a golfer 1300 golfing in sunny weather conditions. Under these conditions, the golf ball may transition from the first configuration 100 to the second configuration 101 as a result of exposure to ambient environmental UV light 1322 from the sun 1318. This transition may occur during use of the golf ball in a game of golf. Generally, ambient environmental UV sunlight on a sunny day may provide from about 0.25 to about 0.5 $W/m^2/nm$ of spectral irradiance at roughly sea level elevation. On a cloudy day, such as shown in FIG. 8, the amount of UV spectral irradiance may be reduced by at least about 50%, or from about 50% to about 80%.

In the second configuration, golf ball 101 may have deeper dimples, as shown in FIGS. 2-7 and discussed above. Therefore, golf ball 101 may achieve a lower trajectory flight path 1308 as compared to a flight path 1306 of a similar golf ball having shallower dimples. Advantageously, flight path 1308 may achieve an increase total shot distance under sunny dry conditions due to roll 1324. Specifically, under sunny conditions the ground may be harder and therefore the golf ball will experience increased roll 1324 after initial landing.

Accordingly, the present disclosure provides golf balls which may be used equally well in both sunny dry weather conditions and wet weather conditions.

As will be apparent to those in the art, because the partially cured ball is intended to remain in the partially cured state until a purchaser or user desires to play the ball or alter the curing level of the ball, the partially cured ball may be stored, transported, and/or maintained in a container, packaging, or other UV-limiting storage device intended to inhibit or prevent accidental or unintended exposure to ambient UV light. For example, the partially cured ball described herein may be stored in a box or pouch made of, including, or coated with ultraviolet light absorbers or blockers of UV radiation. Such materials, which are well-known in the art, may include but are not limited to polycarbonate, acrylic plastic, various other types of polymers, titanium dioxide, zinc oxide, and aromatic molecules conjugated with carbonyl groups. Thus, the manufacturers, shippers, sellers, and, ultimately the end-user may keep the partially cured golf ball in the UV-limiting storage device until the user wishes to play the golf ball. By extracting or removing the partially cured golf ball from the UV-limiting storage device, the user is choosing to expose the golf ball to UV light to commence or allow the curing process.

Figure 10:
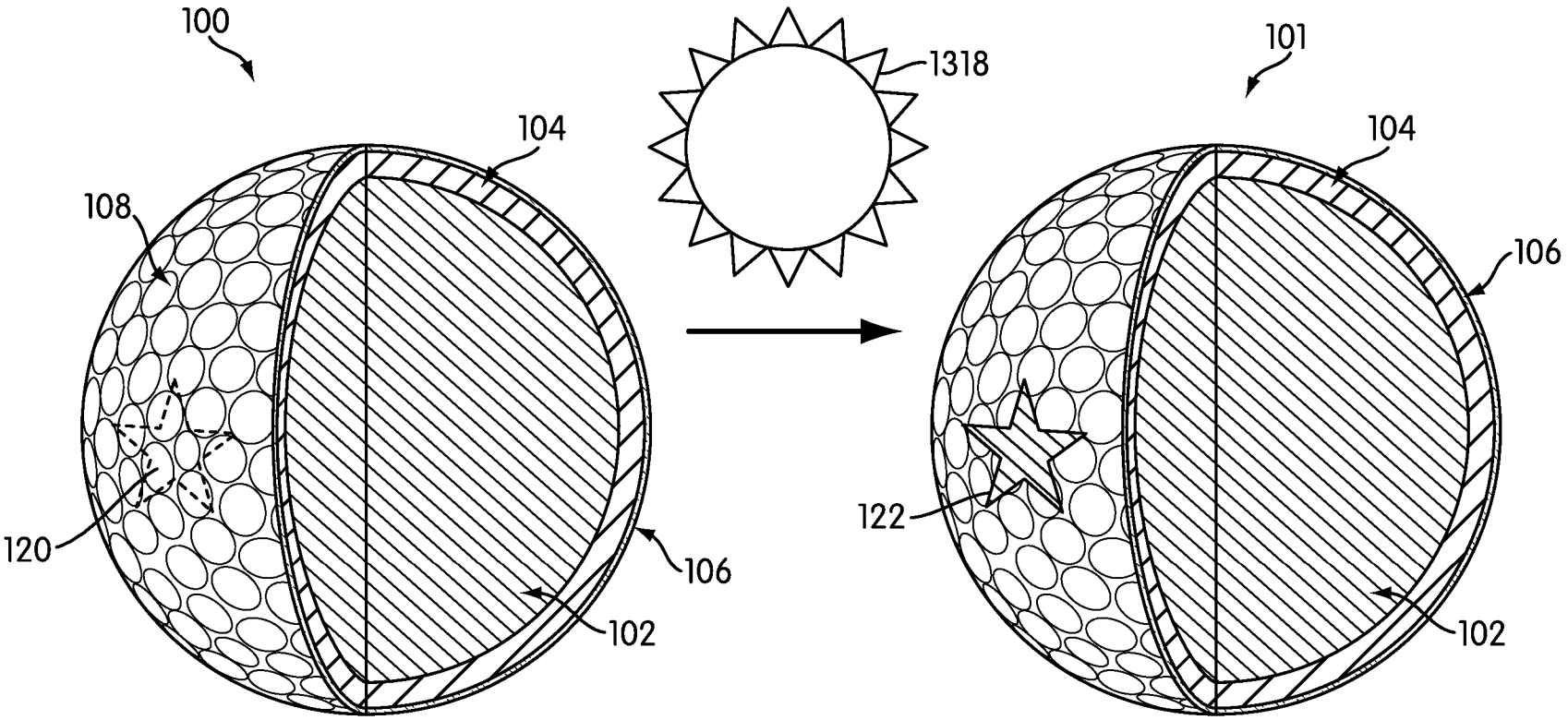
FIG. 10 shows a golf ball having an indictor giving a visual representation of the transition from a first configuration to a second configuration.

FIG. 10 shows the golf ball of FIG. 1 with additional features. Specifically, FIG. 10 shows a golf ball including a visual indicator that may indicate whether the golf ball is in the first configuration 100 or in the second configuration 101. Generally, the visual indicator may exist in a first state 120 in the first configuration 100, and may change into a second state 122 when the golf ball changes into second configuration 101. The visual indicator may be any logo, trademark, lettering, numbering, image, or other visual representation. The visual indicator may be comprised of a UV responsive material such as a UV curable ink. In particular, the visual indicator may be comprised of a UV color changing ink, which inn some embodiments may change color irreversibly. A variety of such inks are generally known in the printing industry. Therefore, visual indicator in the first state 120 may show to a user that the golf ball is in the first configuration 100. After exposure to UV radiation, either from sunlight 1318 or another UV source, visual indicator may change to second state 122 that has a different appearance from the first state. Thus, the visual indicator may show to a user whether the UV curable material is in a partially cured state or in a substantially fully cured state.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A finished golf ball usable in a game of golf, comprising:

a core;

a cover layer substantially surrounding the core, the cover layer including at least one dimple and at least one land area adjacent to the dimple;

a partially cured coating layer overlapping at least a portion of the cover layer, at least a portion of the coating layer comprising a partially cured UV curable material;

wherein the UV curable material present in the partially cured coating layer of the finished golf ball is capable of undergoing further curing when exposed to UV light; and wherein the coating layer of the finished golf ball comprises a first portion comprising the UV curable material and a second portion comprising a non-UV curable material, wherein the first portion is associated with the at least one dimple and the second portion is associated with the at least one land area.

2. The golf ball of claim 1, wherein the portion of the coating layer of the finished golf ball comprising the UV curable material further comprises a polyurethane coating material.

* * * * *